United States Patent [19]

de Munck

[11] 4,041,665

[45] Aug. 16, 1977

[54] INJECTION SEALABLE WATERSTOP AND METHOD OF INSTALLING SAME

[75] Inventor: Eduard H. L. de Munck, The Hague, Netherlands

[73] Assignee: Vredestein N.V., The Hague, Netherlands

[21] Appl. No.: 744,100

[22] Filed: Nov. 22, 1976

[30] Foreign Application Priority Data

Nov. 22, 1975 United Kingdom ..... 48095/75

[51] Int. Cl.[2] ..... E04B 1/62; E04F 15/14; E01C 11/04

[52] U.S. Cl. ..... 52/396; 404/56; 404/65; 404/74

[58] Field of Search ..... 404/56, 47, 48, 64, 404/65, 67, 68, 69, 50, 74; 52/396, 403; 49/475

[56] References Cited

U.S. PATENT DOCUMENTS

| | | | |
|---|---|---|---|
| 784,926 | 3/1905 | Crawford | 404/50 X |
| 2,228,052 | 1/1941 | Gardner | 52/396 |
| 2,400,493 | 5/1946 | Fischer | 404/56 X |
| 3,023,681 | 3/1962 | Worson | 404/56 X |
| 3,099,110 | 7/1963 | Spaight | 404/65 X |
| 3,172,237 | 3/1965 | Bradley | 52/396 X |
| 3,205,629 | 9/1965 | Rumley | 52/396 |
| 3,280,525 | 10/1966 | Crowley | 52/396 X |
| 3,411,260 | 11/1968 | Dill | 404/48 X |
| 3,465,532 | 9/1969 | Belden | 52/396 X |
| 3,891,224 | 6/1975 | Ditcher | 52/396 X |
| 3,968,611 | 7/1976 | de Munck | 404/56 X |

*Primary Examiner*—Nile C. Byers, Jr.
*Attorney, Agent, or Firm*—Karl W. Flocks

[57] ABSTRACT

A waterstop of elastic deformable rubbery material used in concrete structures with a substantially flat middle portion and enlarged side wing anchor sections with elastic or metal anchor strips and sponge material attached to the outer edge of the strips and injection tubes from outside the concrete to the sponge material. The method of installing a waterstop in concrete and after setting injecting a fluid curable or settable material to admit the fluid to the concrete matrix in the region of the sealing extensions.

9 Claims, 5 Drawing Figures

FIG 1
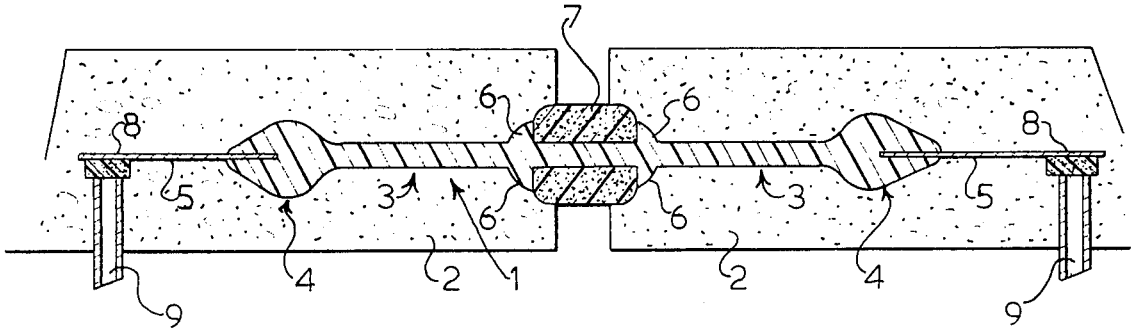
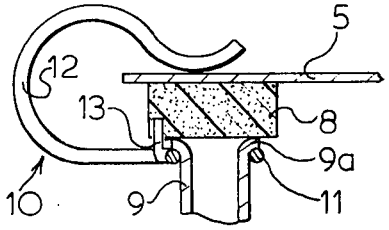
FIG 2
FIG 3
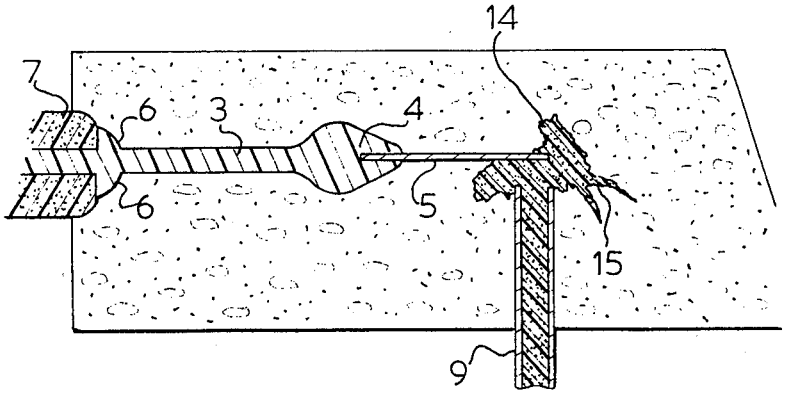

INJECTION SEALABLE WATERSTOP AND METHOD OF INSTALLING SAME

The present invention relates to an injection-sealable water-stop adapted to be installed in concrete structures such as dams, tunnels, water conduits, sewers, buildings etc., and to a method of installing same in such structures.

Water-stops are sealing elements usually made of elastic deformable materials with or without integral elastic and/or metal anchor portions, which water-stops are installed in concrete structures to seal joints, permit expansion and contraction, seal the concrete to other structures, etc. Tunnels, for example, are driven and casings installed therein in section by section manner with the necessity to seal each succeeding section to the preceding section. Large concrete dams also are poured in sections with expansion joints dispersed through the massive structure and sluices, flumes, tunnels, drains, passageways, and other openings incorporated requiring sealing between the latter and the concrete of the dam proper. There are many other structures of concrete requiring expansion joints and/or seals between sections of the concrete, per se, or between the concrete and another structure of the same or different material.

Water-stops of elastic materials heretofore have been of two types namely, passive types and injection-sealed types. The passive type is illustrated in my pending British specification No. 40290/74, filed Sept. 16, 1974, wherein the water-stop has a flat middle section of vulcanized rubber or of an elastic thermoplastic material such as plasticized polyvinyl chloride to each side of which is secured a sponge rubber or plastic around the anchor portions, aggregate can settle and/or collect around the anchors during the pouring operation, or cracks and fissures can form around the anchor-portions by shrinkage effects during the setting or early stages of the cure of the concrete. When any of these eventualities happen, water can permeate the concrete along one side of the water-stop, get around the anchors and permeate the region along the other side of the water-stop to drip out the other side of the supposedly sealed joint. This effect is exaggerated quite considerably when the hydrostatic head of water on the joint is greater than about 5 or 10 meters or when the concrete (as in a dam exposed to sunlight) is subject to significant expansion, contraction or other forms of movement around the joint. Under any of these conditions, the elastic material of the water-stop is extended and the elastic anchor portions may either be slightly reduced in size or at least the contact pressure between the anchors and the concrete may be reduced slightly leaving a potential area of leakage, especially in those regions of the water-stop as are embedded in an imperfect concrete matrix.

It has thus been recognized that better sealing around the anchor regions of elastic water-stops was needed. The injection-sealed type of water-stop is illustrated in W. German Pat. No. 1, 116,369 (Grunau). In this type of prior water-stop, one or more tubes are integrally molded in each of the enlarged elastic anchor portions and, after the concrete is poured, a fluid self-setting or self-curing material is injected into the tubes under pressure which is maintained until the concrete sets and the fluid material solidifies and becomes solid in the tube. The pressurized expansion of the anchor portions is supposed to compensate for the shrinkage of the concrete. While the latter occurs, such expansion can not fill porous regions of concrete around the anchors nor can it effectively seal cracks, fissures or other imperfections which penetrate the concrete matrix to a significant depth away from the anchor. Permeation leakage of water under pressure can still occur around the ends of the expanded water-stop.

Environmental pollution of waters has posed unusual problems for older dams and tunnels sealed by crushable metal seals, usually those made of copper. Industrial acids in streams, canals, and other surface drainage areas are rapidly consuming such metal seals with attendant rising leakage rates. The crushable metal type of seal has heretofore been the only type of seal considered effective under high hydrostatic heads of 10 to 30 meters or more.

Surprisingly, it has been found that the above disadvantages of existing water-stops, and especially of elastic water-stops, can be overcome by an elastic water-stop which has incorporated therein a displaceable and/or rupturable element attached to the anchor elements and especially to a metal anchor element, such displaceable or rupturable element being adapted to being ruptured, displaced and/or compressed by the injection under pressure of a fluid form of a self-curing or self-setting polymeric or otherwise setable material whereby the fluid material escapes into the concrete matrix filling and sealing any imperfection therein. After in situ cure or setting in such imperfections of the injected material occurs, permeation leakage of water around the water-stop anchors is much less likely to occur and any leakage as occurs will be much smaller and longer delayed.

According to the present invention there is provided a water-stop having a generally flat middle section on either end of which is an integral enlarged anchor section also of elastic material and usually of bulbous shape, in each of which anchor sections is carried an integral metal anchor member, preferably in the form of a flat metal strip, and to each such metal anchor there is affixed a more or less continuous pad or strip of an elastic sponge material, preferably closed-cell sponge material, extending parallel to the sides of the joint to be sealed and in which there terminates at intervals an injection tube. The tube preferably is attached substantially normal to and temporarily sealed by the sponge of the pad. When installed in a concrete structure, the tubes project out of the concrete and can be attached to a pumping circuit which injects a fluid, self-curing or setting form of material through the tube or tubes and either rupturing or compressing and displacing the sponge overlying the tube end allowing fluid to escape into the concrete matrix surrounding the sponge pad and the metal anchor strip filling any air bubbles, cracks, or fissures in the concrete surrounding the metal and effectively completing the seal. Such tubes preferably are installed at intervals along a continuous sponge strip or pad affixed along the length of at least one side of each of the metal anchor members such that the pressurized fluid can permeate along-side, through and on all sides of the sponge reaching all or nearby all of the concrete imperfections as may occur along that side of the metal strips. The sponge pad strip itself is thus after cure of the fluid to the solid state encased in solid elastic material and is itself not a weak point for permeation leakage of water.

Preferably the material of the sponge injection tube seal pad is a closed-cell sponge form of rubber, synthetic rubber or of a polyurethane elastomer. The fluid form of injection material also is preferably a liquid polyurethane mix or liquid epoxy resin composition formulated to self-cure with a pot-life of at least one hour, and most preferably between 1 and 3 hours, such that the material can be mixed and injected while remaining in liquid form under pressure in the concrete structure for a time sufficient to permit complete penetration along the length of the foam pad and the metal anchor element and reach all imperfections of the concrete matrix in the immediate proximity of each of the metal anchor elements. After the fluid congeals and solifies, it effectively seals the tubes which can be cut off for appearance sake.

If desired, and if the water-stop is to be utilized in a concrete structure in which convenient access during installation may be had to both sides of the water-stop, sponge pads and injection tubes can be attached to both sides of the metal anchor elements or strips so that injection sealing on both sides of each of the anchors elements can be achieved.

The design of the water-stop of the present invention requires no expensive or special fabrication technique and does not add unduly either to its cost of manufacture or of its cost of installation. The solid, elastic portion of the water-stop is easily made in one-piece by extrusion in continuous lengths in which the metal anchor strips are subsequently adhesively secured and the resulting subassembly vulcanized, if necessary, the various foam strips then attached and the resulting partially assembled water-stop transported to the job-site as continuous rolls. The water-stop is then supported in the concrete form and the injection tubes subsequently attached as by spring clamps together with any needed protective supports with the ends of the tubes brought out of the form to a convenient location for attachment to the injection system. The injection should employ a pressure sufficient to compress, crush or displace the sponge pad strip, and should occur after pouring of the concrete, and preferably after the concrete has set and/or cured to a point where the greater part of concrete shrinkage has occured. Obviously, the injection preferably should also occur before the water-stop is exposed to a hydrostatic head of water.

The present invention will now be further described with reference to the accompanying drawings in which;

FIG. 1 is in a longitudinal section through an assumed vertical joint in a vertical concrete structure, the figure showing a water-stop of the present invention installed but not yet injection sealed;

FIG. 2 is an enlarged view of one of the ends of the water-stop of FIG. 1 showing a spring clamp for securing the injection tubes to the foam pads;

FIG. 3 is a partial view of one end of the water-stop of FIG. 1 somewhat enlarged and showing, after injection sealing, penetration of a fluid elastomer into several aggregate collections in the vicinity of the metal anchor strip and into a void in the concrete possibly caused by deflection or movement of the metal anchor strip after partial setting of the concrete had occured;

Figure 4:
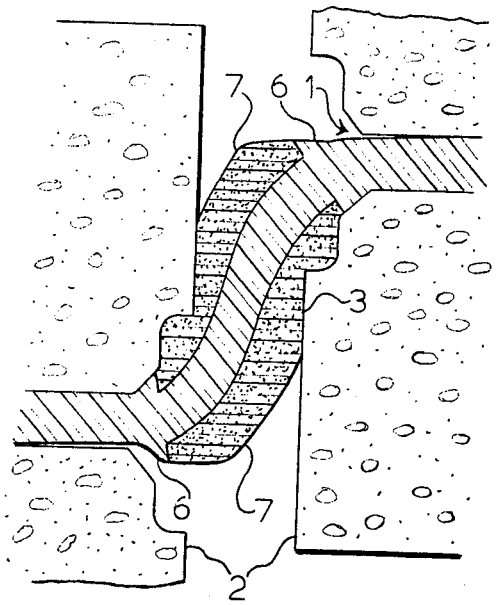
FIG. 4 is a partial view, also in horizontal section, showing how the sealing strip of this invention accomodates itself to expansion and/or other relative movements of the two concrete edges of the joint while maintaining a seal.

In FIG. 1, the water-stop 1 of the present invention is shown installed to seal a vertical joint between two walls 2 of a vertical concrete structure, this figure, however, showing the joint as it appears after the concrete has been poured but before the injection sealing strip has occured. The water-stop 1 comprises a strip of rubber or of elastic plastic having a substantively flat mid-section 3 of substantially rectangular cross section on either outer edge of which is an enlarged anchor section 4 of bulbous or pearshape and a substantially flat metal anchor strip 5 carried by and integrally and adhesively-secured in an edgewise slot in each elastic anchor section 4. Since the water-stop 1 is continuous in a direction normal into and out of the plane of the paper in FIG. 1, the water-stop 1 may be seen to have a thin mid-section 3 and substantially thicker outer edges 4 each of which terminates in a continuous metal anchor strip 5. At about the middle of mid-section 3, and on each side thereof there are provided a pair of integral, juxtaposed shoulders 6 or retainers between each pair of which is adhesively - secured a continuous strip 7 of closed-cell elastic sponge material which cooperate to seal the form for the concrete preventing loss of concrete "milk" in the area of the water-stop during and after the pour. The retainer shoulders 6, moreover provide a thickened area preventing damage to the thin mid-section 3 of the water-stop during flexing, see FIG. 4.

As appears in FIG. 1, near the outer edge of each of the metal anchor strips 5 there is adhesively - secured a continuous strip or pad 8, also of a closed-cell elastic sponge material which may be of a vulcanized rubbery material, foamed polyurethane, or the like. To each such pad 8 there is mounted a hollow tube 9 in open communication with and sealed by the material of pad 8. It should be understood that one or more of tubes 9 are so mounted at intervals along the vertical length of each pad 8 to permit sealing of the entire outer edge of each metal anchor strip 5.

As shown in FIG. 2, the tube 9 can be mounted to the pad 8 by a spring clamp 10 which has a tight fitting circular loop 11 into which the tube 9 having a slightly flaired end portion 9*a* is fitted and retained, and an enlarged spring clip or loop 12 which passes over the end to the other side of the metal anchor strip 5. The end 13 of circular loop 11 is bent sharply at right angles so as to be pressed by spring action into the sponge pad 8 to assist in preventing displacement of the clamp during the concrete pouring operation.

It should be understood that means other than spring clamp 10 can be employed to secure and hold tubes 9 in contact with the pads 8.

The spring clamp 10 could be a double clamp having a circular loop 11 on each of its ends so as to secure a second tube 9 to a second sponge pad 8 on the opposite side of each of the anchor strips 5 where it is desired to injection seal both sides of each of the strips 5.

In FIG. 3 the water-stop is shown after the injection sealing step has been performed. For clarity no mode of attaching the tube is shown in the figure. Note several occlusions 14 of aggregate have been filled with solid injected material as also has a shrinkage fissure 15 located near the end of metal anchor strip 5 which somehow may have been bent or deflected during or just after the concrete pouring step causing the fissure 15 shown. Note also that fluid injection material also has penetrated for a small distance along the underside of metal anchor strip 5 on both sides of foam pad 8 which after curing or sitting effectively encases the pad 8 in solid material so the pad itself is not a point of leakage.

FIG. 4 of the drawings shows the water-stop 1 in the deformed condition as may occur when differential longitudinal and/or vertical expansion of the wall sections 2 of the concrete structure have occured.

Figure 5:
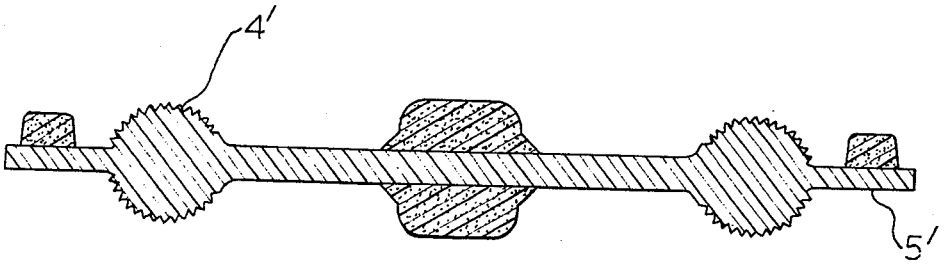
FIG. 5 is a modified embodiment of the embodiment of FIG. 1.

FIG. 5 illustrates a modified embodiment of the waterstop of the present invention. Bulbous anchor portion 4' has a different shape from that previously illustrated and anchor strips 5' extend therefrom integrally attached thereto.

It is to be understood that the particular shape of the bulbous anchor portions 4, the shape of disposition of sponge pads 7, or the shape or disposition of the metal anchor strips 5 could differ substantially from those shown herein without interfering with the attachment or functioning of the pads 8 and injection tubes 9 in the injection sealing step.

It will be obvious to those skilled in the art that various changes may be made without departing from the scope of the invention and the invention is not to be considered limited to what is shown in the drawings and described in the specification.

What is claimed is:

1. A water-stop composed of elastic deformable rubbery material for use in concrete structures which comprises a substantially flat middle portion and enlarged side wing anchor portions provided with sealing means, a pad of elastically-deformable sponge material being attached to one surface of at least of each side sealing means and attached to each said pad to as to be sealed thereby, and there being at least one injection tube of sufficient length to reach the outside surface of the concrete in which the water-stop is to be installed.

2. A water-stop as claimed in claim 1 in which each side sealing means is attached substantially normal to each said pad.

3. A water-stop as claimed in claim 1 in which there is a strip of elastically-deformable sponge material secured to the flat middle portion.

4. A water-stop as claimed in claim 1 in which each side tube seal pad is secured to its respective sealing portion and its respective injection tube is secured thereto by a field-installable clamp.

5. A water-stop as claimed in claim 4 in which the clamp is made of spring wire.

6. A water-stop as claimed in claim 1 in which said sealing means is of metal material.

7. A water-stop as claimed in claim 1 in which said sealing means is of elastic material.

8. A method of installing a water-stop element in a concrete structure wherein a water-stop having elastic and/or metal sealing portions is buried in concrete which comprises pouring the concrete and, after the concrete has set, injecting a fluid curable or settable material to improve the seal between the concrete and the sealing portions, the fluid material being injected so as to rupture or displace an elastic sealing material and admit the fluid material to the concrete matrix in the region of the elastic and/or metal sealing portions.

9. A method as claimed in claim 8 in which the rupturable or displaceable elastic sealing material is elastic sponge material adhered to the sealing means attached to elastic anchor portions which are buried in concrete.

* * * * *